US011465800B2

(12) United States Patent
Freeman

(10) Patent No.: US 11,465,800 B2
(45) Date of Patent: Oct. 11, 2022

(54) GREETING CARD BAKERY PRESENTATION BOX

(71) Applicant: Orlando Freeman, Ellenwood, GA (US)

(72) Inventor: Orlando Freeman, Ellenwood, GA (US)

( * ) Notice: Subject to any disclaimer, the term of this patent is extended or adjusted under 35 U.S.C. 154(b) by 57 days.

(21) Appl. No.: 17/012,121

(22) Filed: Sep. 4, 2020

(65) Prior Publication Data

US 2021/0070492 A1 Mar. 11, 2021

Related U.S. Application Data

(60) Provisional application No. 62/897,580, filed on Sep. 9, 2019.

(51) Int. Cl.
*B65D 5/42* (2006.01)
*B65D 85/36* (2006.01)

(52) U.S. Cl.
CPC ..... *B65D 5/422* (2013.01); *B65D 5/4204* (2013.01); *B65D 85/36* (2013.01); *B65D 2203/12* (2013.01); *B65D 2585/363* (2013.01)

(58) Field of Classification Search
CPC ..... B42D 15/045; B65D 5/42; B65D 5/422; B65D 5/4204; B65D 5/4233; B65D 85/36; B65D 2203/12; B65D 2585/363
USPC ..... 206/232, 459.5
See application file for complete search history.

(56) References Cited

U.S. PATENT DOCUMENTS 4,791,741 A * 12/1988 Kondo ..... G06Q 20/346 283/117
5,038,930 A * 8/1991 Holtkamp, Jr. ..... B65D 5/5007 206/232
5,232,087 A * 8/1993 Schluger ..... B42D 15/045 206/232
5,277,307 A * 1/1994 Kelly ..... A47G 1/14 206/232
5,289,917 A * 3/1994 Chabria ..... B42D 15/045 206/232
5,444,767 A * 8/1995 Goetcheus ..... H04M 1/642 40/124.03
5,458,235 A * 10/1995 Stone ..... B65D 5/4204 206/232
5,497,876 A * 3/1996 Fleming ..... B42D 15/045 206/232
5,575,384 A * 11/1996 Saye ..... B42D 15/045 206/232
7,802,386 B2 * 9/2010 Mandelbaum ..... B42D 15/045 40/717
8,104,670 B2 * 1/2012 Mitchell ..... B65D 5/4233 229/115

(Continued)

*Primary Examiner* — Bryon P Gehman
(74) *Attorney, Agent, or Firm* — Brennan, Manna & Diamond, LLC

(57) ABSTRACT

The present invention relates generally to a presentation box for a gift, a cake or a celebratory bakery item. More specifically, the invention relates to a presentation box comprised of a cake box having a repositionable lid, and a greeting card that is fixedly attached to the lid of the cake box. In differing embodiments of the presentation box, the lid of the cake box may have a transparent viewing window, as well as a speaker, a prerecorded message or song, and a plurality of LED lights that are activated and play once the greeting card and/or repositionable lid are opened.

16 Claims, 6 Drawing Sheets

(56) References Cited

U.S. PATENT DOCUMENTS

| | | | | |
|---|---|---|---|---|
| 9,002,737 | B2 * | 4/2015 | Wilen | B42D 5/025 705/26.1 |
| 9,597,916 | B2 * | 3/2017 | Begin | B65D 25/101 |
| 9,870,561 | B2 * | 1/2018 | Kramer | G06Q 30/0207 |
| 10,625,530 | B2 * | 4/2020 | Nelson | B65D 5/5213 |
| 2003/0230501 | A1 * | 12/2003 | Smolev | B42D 15/045 206/232 |
| 2009/0101527 | A1 * | 4/2009 | Triolo | B42D 3/123 206/232 |
| 2011/0210160 | A1 * | 9/2011 | Vantieghem | G11B 20/10 281/21.1 |
| 2014/0069828 | A1 * | 3/2014 | Lasecki | B65D 5/4233 206/232 |
| 2018/0072086 | A1 * | 3/2018 | Mayer | B65D 5/4204 |

* cited by examiner

GREETING CARD BAKERY PRESENTATION BOX

CROSS-REFERENCE TO RELATED APPLICATION

The present application claims priority to and the benefit of U.S. Provisional Application No. 62/897,580 filed on Sep. 9, 2019, which is incorporated herein by reference in its entirety.

BACKGROUND

The present invention relates generally to a new and unique presentation box for a gift, a cake or other bakery items. More specifically, the invention relates to a presentation box for a cake that includes an integrated greeting card that is fixedly attached to the lid of the presentation box. In alternative embodiments, the lid of the presentation box may also be comprised of a transparent or a translucent viewing window to allow a user to view the top surface of the cake or other bakery items stored within the presentation box, as well as a speaker, a pre-recorded song or message, and/or a plurality of lights that are activated and played once the greeting card and/or the lid of the presentation box is opened. Accordingly, the present specification makes specific reference thereto. However, it should be appreciated that aspects of the present invention are also equally amenable to other like applications, devices and methods of manufacture.

By way of background, bakery items, such as cakes, cookies and other confectionary items, are commonly used for celebrations such as birthdays, anniversaries, holidays, graduation parties, etc. Typically, a cake or other bakery item is brought to such events in a box that is typically made from paperboard and is normally opaque and unadorned. The cake or other bakery items may also be accompanied by a separate greeting card, such as a birthday card, an anniversary card, a holiday card, a graduation card, etc. to commemorate the celebration, and that is appropriate for the particular event. However, both the bakery item and the greeting card are traditionally manufactured and provided separately. This allows for the possibility of the misplacement of one or both items during transport, as well as the general inconvenience associated with having to produce, transport, manage and present two separate items to a recipient at the same time. In addition, a user will also incur the cost of both the greeting card and the cake or bakery item, as they are sold separately, and may also have to be purchased at two separate and apart locations, which further the inconvenience. Moreover, it may be difficult for a gift giver to match an appropriate greeting card with the bakery item to be gifted because the themes of each item do not match or otherwise relate to one another.

Therefore, there exists a long felt need in the art for a storage or presentation box for a cake or celebratory bakery item having an integrated greeting card, thereby eliminating the need for a user to purchase and be responsible for both a cake or other bakery item and a card as two separate items. There is also a long felt need in the art for a combination presentation box and greeting card wherein the theme or decorations of the presentation box match or otherwise relate to the theme of the greeting card. Additionally, there is a long felt need in the art for a presentation box and integrated gift card that allows the user to view the contents contained within the presentation box without having to physically open the box and while still offering the functionality of a greeting/celebratory card and bakery box. Moreover, there is a long felt need in the art for a presentation box/gift card combination that may be personalized, and that is comprised of activatable lights and prerecorded sounds. Finally, there is a long felt need in the art for a combination presentation box and greeting card that is safe and easy to use, and relatively inexpensive to manufacture.

In one exemplary embodiment, the present invention is a storage or presentation box for a gift, a cake or other bakery good, wherein the presentation box includes an integrated greeting card, a box body, a repositionable lid, and a viewing window. The greeting card portion of the combination has a first or cover page, and a second page that can be customized to fit any occasion including, without limitation, birthdays, anniversaries, graduations, other celebratory events, etc. The spine of the greeting card is fixedly attached to one edge of the body of the presentation or storage box such that the spine of the card is generally parallel with the select edge of the presentation box.

The viewing window of the presentation box may be a transparent or translucent panel or window that may be in the form of a geometric shape such as a square, a circle, an oval, a rectangle, etc., a non-geometric shape, or may take on a shape of a character, a letter, or a well-known or famous configuration or image (e.g. St. Louis Arch, Empire State Building, NY city skyline, etc.). In a further embodiment of the invention, the presentation box/gift card combination may also comprise a plurality of lights and a speaker that allows a user to record a song or phrase, and have the song or phrase automatically played when the lid of the presentation box or the greeting card portion of the device is opened. The speaker may also be in electrical communication with a memory device or music player that is further comprised of pre-recorded songs or messages that may be personalized by the presenter of the presentation box/greeting card combination. In addition, the card or presentation box may be further comprised of a QR code which can be scanned by a smart phone or other device such as a tablet in order to trigger the playing of a video on a specific URL or other downloadable application.

In this manner, the storage or presentation box for a cake or other bakery item and the integrated gift card of the present invention accomplishes all of the forgoing objectives, thereby eliminating the need for a user to purchase both a presentation box and a separate greeting card, as well as providing the user with a means to view the gift that is being stored within the presentation box and provide the user the convenience of having both items in one single device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an improved bakery presentation box and greeting card combination. The presentation box preferably comprises a generally rectangular cardstock or cardboard body/box that can be used to store, transport, present and/or view a gift, a cake, or a bakery or other confectionary item to be given to a recipient. The box further comprises a lid or cover that has a plurality of flaps that engage the interior of the box along select walls to ensure that the box remains closed. The lid may also have an integrated transparent or translucent viewing window that, in differing embodiments of the device, may be generally rectangular, square, or circular shaped, or may have other themed or famous characters or images. The viewing window allows a user to view the top surface of the cake or bakery items housed within the combination presentation box and gift card without having to physically open the combination device. A greeting card is permanently affixed to the lid of the box, preferably immediately adjacent to a lid edge. More specifically, the edge is generally parallel to the spine of the greeting card. By providing an integrated product offering, the present invention eliminates the need for the user to purchase a separate greeting card for the specific occasion in addition to the cake or bakery items. The combination box/gift card may also comprise a speaker or other sound emitting device that plays a pre-recorded song or phrase when the presentation or gift box lid is opened (e.g., Happy Birthday) or a personalized song/phrase recorded by the user, as well as a plurality of lights that are activated in the same manner and at substantially the same time as the commencement of the sound.

In a further exemplary embodiment of the presently described invention, a combination greeting card and presentation box is presented and includes a box having a plurality of side walls joined to one another, a bottom connected to a bottom edge of each of the side walls, with the bottom and side wall forming an enclosure. A top or lid is connected to at least one of the side walls forming a joining edge, and the joining edge allowing the top to move from a closed position to an open position, and vice versa. The top is further comprised of edges defining a perimeter, and a window provided in the top and within the perimeter. A greeting card connected to at least one of the edges of the top is also provided, wherein the greeting card comprises a theme and the theme includes both graphics and textual information. The greeting card covers the viewing window in the top upon presentation to the recipient, but is repositionable from a closed position to an open position to allow for viewing of the cake in the box.

In a still further exemplary embodiment of the presently described invention, a presentation box is described and includes a box that has a theme and related indicia and images provided on the box. The box has first through fourth walls and a top and bottom, with each of the walls joined to one another along their side edges, and the bottom joined to the walls along a bottom edge of the walls. The box is formed from a first material. The top is joined to at least one of the first through fourth side walls along a top edge thereby forming a joining edge. The top edge is hingedly connected to the joining edge to permit moving of the top from a first position to a second position and vice versa. The top also has first, second, third and fourth edges. The presentation box further includes a greeting card that has at least a first panel, with the first panel connected to one of the first, second, third or fourth edges of the top, and being repositionable from a first position to a second position and vice versa.

In a yet still a further exemplary embodiment of the presently described invention, a method of using a presentation box is described and includes the steps of initially selecting a theme from a catalog. The theme may be any sort of celebratory, conciliatory or other expression or emotion. Next, one chooses graphics and indicia relating to the theme. The graphics can be from a stock collection of indicia, or graphics or the user may personalize the particular selection. Then, the user picks at least one of a sound recording or illumination feature. Again, the user is presented with the opportunity to provide their own personalized sound, message, image or to choose from a pre-recorded collection. Then, a box and an integrated greeting card are produced, with each of the box and greeting card having elements relating to the theme. Finally, a bakery item is inserted into the box and the box and bakery item are presented to a recipient as a single item. The greeting card and its related features are simultaneously activated so that the at least one of the sound recording or illumination feature will commence operation with opening of one or more of the box or the greeting card.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
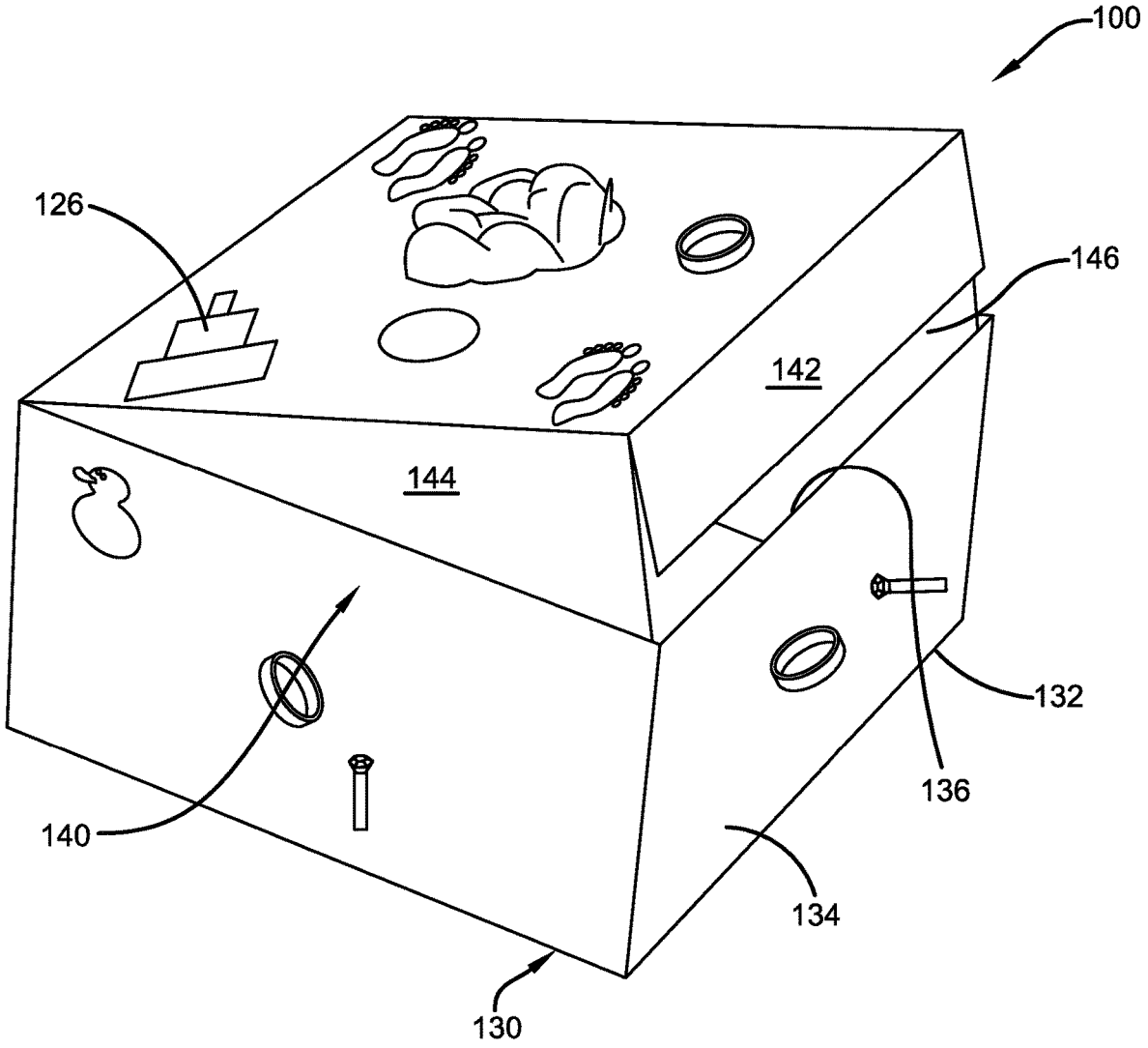
FIG. 1 illustrates a perspective view of one potential embodiment of a combination greeting card and presentation box of the present invention in a partially opened position in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there is a long felt need in the art for a combination presentation box and integrated greeting card that eliminates the need for a user to purchase and be responsible for both a cake or other bakery item and a card as two separate items. There is also a long felt need in the art for a combination presentation box and greeting card wherein the theme or decorations of the presentation box match or otherwise relate to the theme of the greeting card, and that allows the user to view the contents contained within the presentation box without physically opening the same. Moreover, there is a long felt need in the art for a presentation box/gift card combination that may be personalized and that is comprised of activatable lights and prerecorded sounds.

Referring initially to the drawings, FIG. 1 illustrates a perspective view of one potential embodiment of a combination greeting card and presentation box 100 of the present invention in a partially opened position. The presentation box 100 is preferably comprised of an integrated gift card 110 and a generally square, rectangular, or round/circular body or box 130 that may be constructed from cardboard, cardstock, or other firm paper-based material. In a preferred embodiment of the present invention, card 110 and box 130 are preferably comprised of a roughly 60 to 110-pound card stock.

In the embodiment depicted in FIG. 1, box 130 is generally cube-shaped and further comprised of a plurality of side walls 134, a bottom 132, and a lid or top 140. It should be understood that the shape of the presentation box 130 is not limited to a cube, square or rectangular shape, and that the box 130 may be any shape and size that can accommodate the bakery goods being transported therein. For example, the shape of the box 130 may be generally round if the cake is round, or oval if, for example, the cake is in the general shape of a football.

The lid or top 140 of the box 130 is further comprised of a first flap 142, a second flap 144 and a third flap 146 that each extend downwardly from the top surface 148 of the lid 140 and into the interior 136 of the box 130 when the lid 140 is closed. Once the second and third flaps 144/146 come into contact with the top of the bottom surface 132 of the box 130, the lid 140 is effectively closed and the friction of the flaps 144/146 against side wall 134 tend to secure the lid 140 to the box 130 in a closed position. More specifically, the lid 140 is moveable from a first or open position to a second or closed position relative to the box 130 by the recipient or user of the combination presentation box/gift card 100. Further, the edges of the top 140 form an outer perimeter which contains the window to be discussed in a later paragraph. The user may open the top or lid 140 via pressing inwards on the first flap 142 while simultaneously pulling the lid 140 upwards (i.e., away from the box 130), thereby creating separation between the exterior surface of the first flap 142 and the interior surface of the side wall 134.

Figure 2:
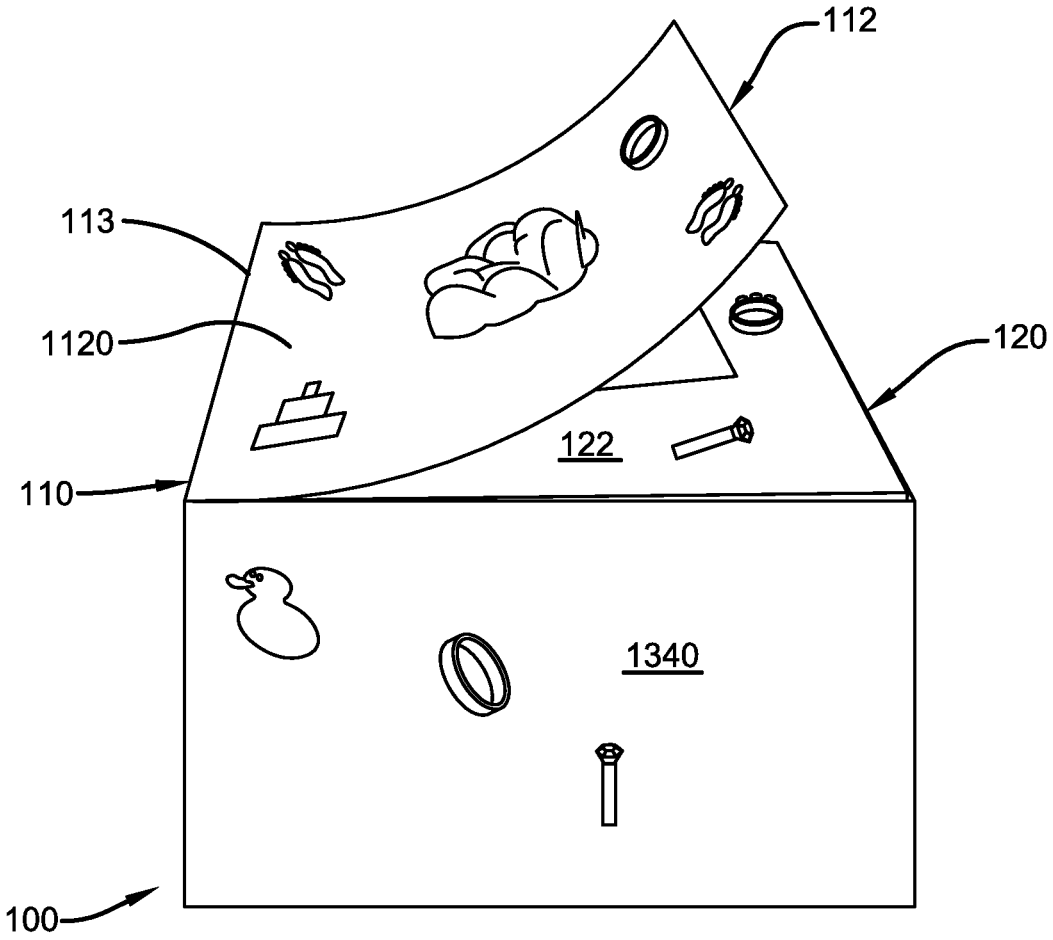
FIG. 2 illustrates a perspective view of one potential embodiment of a combination greeting card and presentation box of the present invention, wherein the lid of the box portion is in a closed position and the greeting card portion is in a partially opened position in accordance with the disclosed structure.

FIG. 2 illustrates a perspective view of one potential embodiment of a combination greeting card and presentation box 100 of the present invention, wherein the lid 140 of the box portion 130 is in a closed position, and the greeting card portion 110 is in a partially opened position in accordance with the disclosed structure. In this particular embodiment of the combination box/card 100, the top surface 148 of the lid or top 140 has the second page 120 of a greeting card 110 affixed along a common edge with the top 140, where the top 140 is joined to the side walls 134 of the box 130, thereby creating a joining edge and showing the joining edge as being substantially adjacent or aligned with the edge of the top 140 that joins to the top edge of the side wall 134.

The greeting card 110 may be made from a different material than the presentation box 130, and preferably has a weight that ranges from between 65 to 80-pound stock. The second page 120 has a front surface 122 that may contain any combination of text 124 or images 126 depending upon the application and the occasion giving rise to the card 110. Further, the second page 120 is fixedly attached to a first page 112, with one edge 113 of the first page 112 (e.g. the spine of the greeting card) being fixedly attached to one side wall 134 of the box 130, such that the top edge of said side wall 134 runs substantially parallel in direction to one edge of the first page 112 of the card 110. This fixed connection allows the greeting card 110 and, more specifically, the first page 112 of the greeting card 110 to be articulated (i.e., flipped open) in a manner that allows a user to view the second page 120 of the greeting card 110 and its contents. The greeting card 110 can then be moved from a first position where it conceals or covers the window (discussed below) contained in the top or lid 140 of the box 130 to a second or open position (or vice versa), wherein the contents of both the greeting card 110 and the interior of the box 130 are visible to the recipient without opening the box 130.

As previously mentioned, the combination greeting card and presentation box 100 of the present invention may further comprise a generally transparent or translucent viewing window 150, and the second page 120 of the greeting card 110 may be capable of being flipped around or about its fixed connection to the box 130 to reveal the window 150, which is preferably located along the top 140 (though it may also be located elsewhere along box 130, such as on sidewalls 134). Window 150 is useful for allowing a user, such as the recipient, to view the contents of the box 130 prior to opening of the same. The first page 112 of the greeting card 110 may also be comprised of any combination of text 114 and/or images 116, which can include phrases such as, but not limited to, "Happy Birthday!", "Congratulations!", "Happy Anniversary!", etc.

Figure 3:
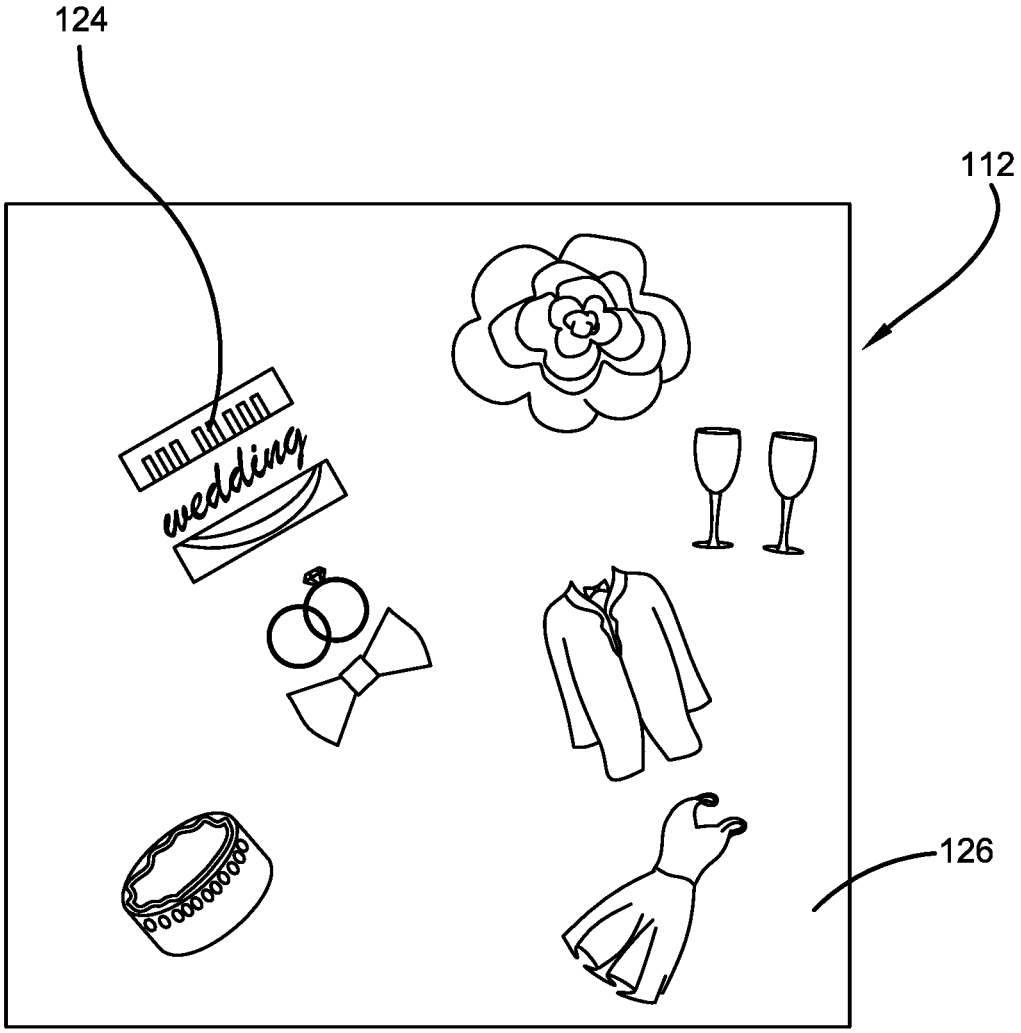
FIG. 3 illustrates a top perspective view of one potential embodiment of the front surface of the first page of the greeting card portion of the combination greeting card and presentation box of the present invention in accordance with the disclosed structure.

FIG. 3 illustrates a top perspective view of one potential embodiment of the front surface 1120 of the first page 112 of the greeting card portion 110 of the combination greeting card and presentation box 100 of the present invention in accordance with the disclosed structure. More specifically, the front surface 1120 of the first page 112 comprises a first theme associated with a wedding and having a plurality of indicia and graphics 124, 126. In a preferred embodiment, the theme of the gift card 110 will match or relate to the theme of the gift box 110 shown, by way of example, in the graphics 126 depicted on the exterior of box 130. However, it is also contemplated that the box 130 may comprise a first theme and the gift card 110 could comprise a second theme that is different from, or unrelated to, the first theme.

Figure 4:
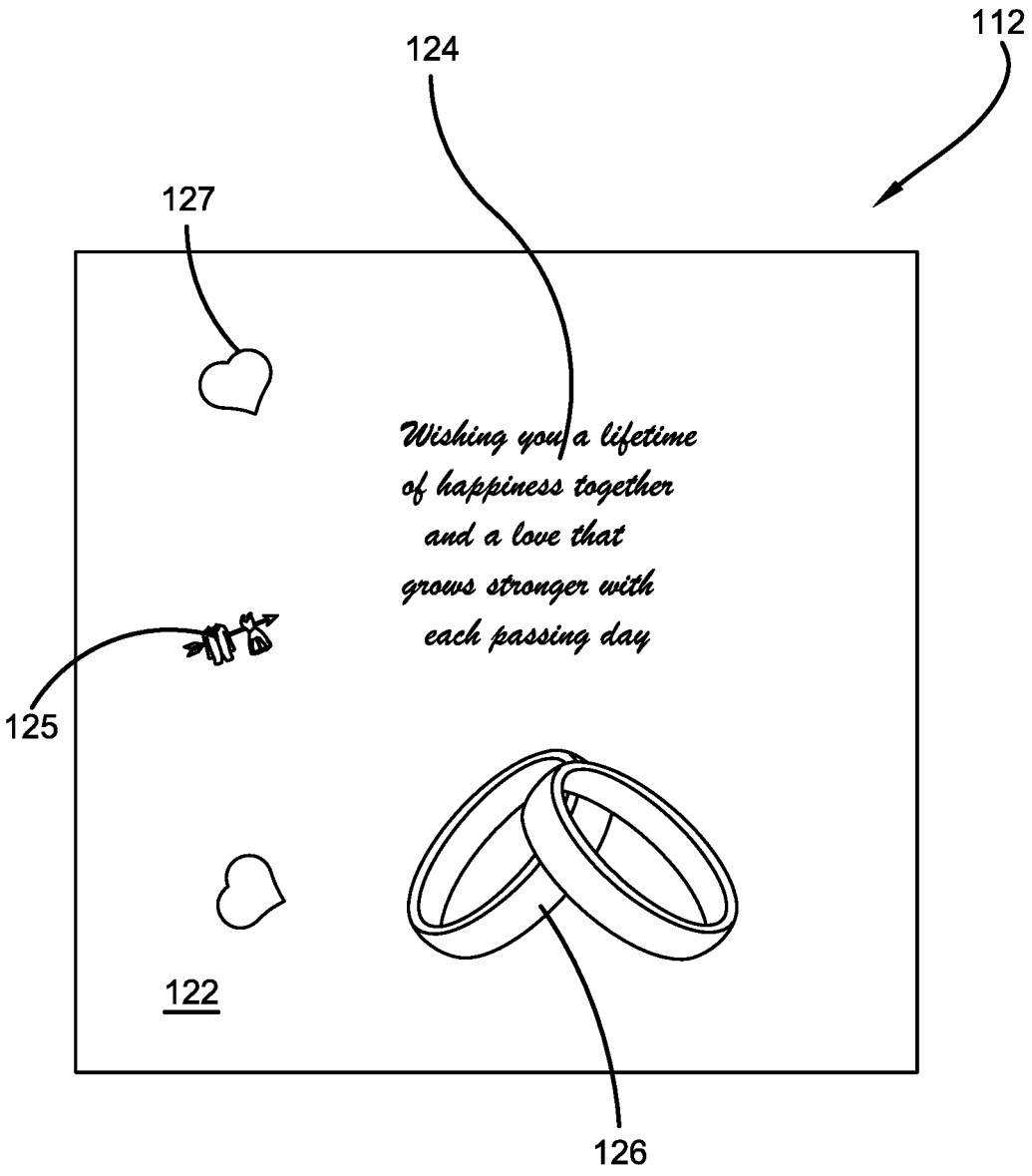
FIG. 4 illustrates a top view of one potential embodiment of the front surface of the second page of the greeting card portion of the combination greeting card and presentation box of the present invention in accordance with the disclosed structure.

FIG. 4 illustrates a top view of one potential embodiment of the front surface 122 of the second page 120 of the greeting card portion 110 of the combination greeting card and presentation box 100 of the present invention in accordance with the disclosed structure. FIG. 4 again illustrates various text and graphical information 124, 126 relating to a particular theme of the celebratory event, but in this FIG. has some additional personalized details which may be selected by the purchaser of the combination presentation box and gift card 100. In this way, a purchaser can select from a catalog of both fixed graphics and text, or add their own unique graphics and/or text, to further personalize the combination box and greeting card 100 in honor of the celebratory event. Once selected, the box and greeting card combination 100 can be generated either remotely for delivered to the purchaser for later insertion of the cake or bakery items, or it can be printed or imaged at the bakery, so that the presentation box and gift card combination 100 can be produced at the same time the order for the bakery item(s) is requested and fulfilled.

Figure 5:
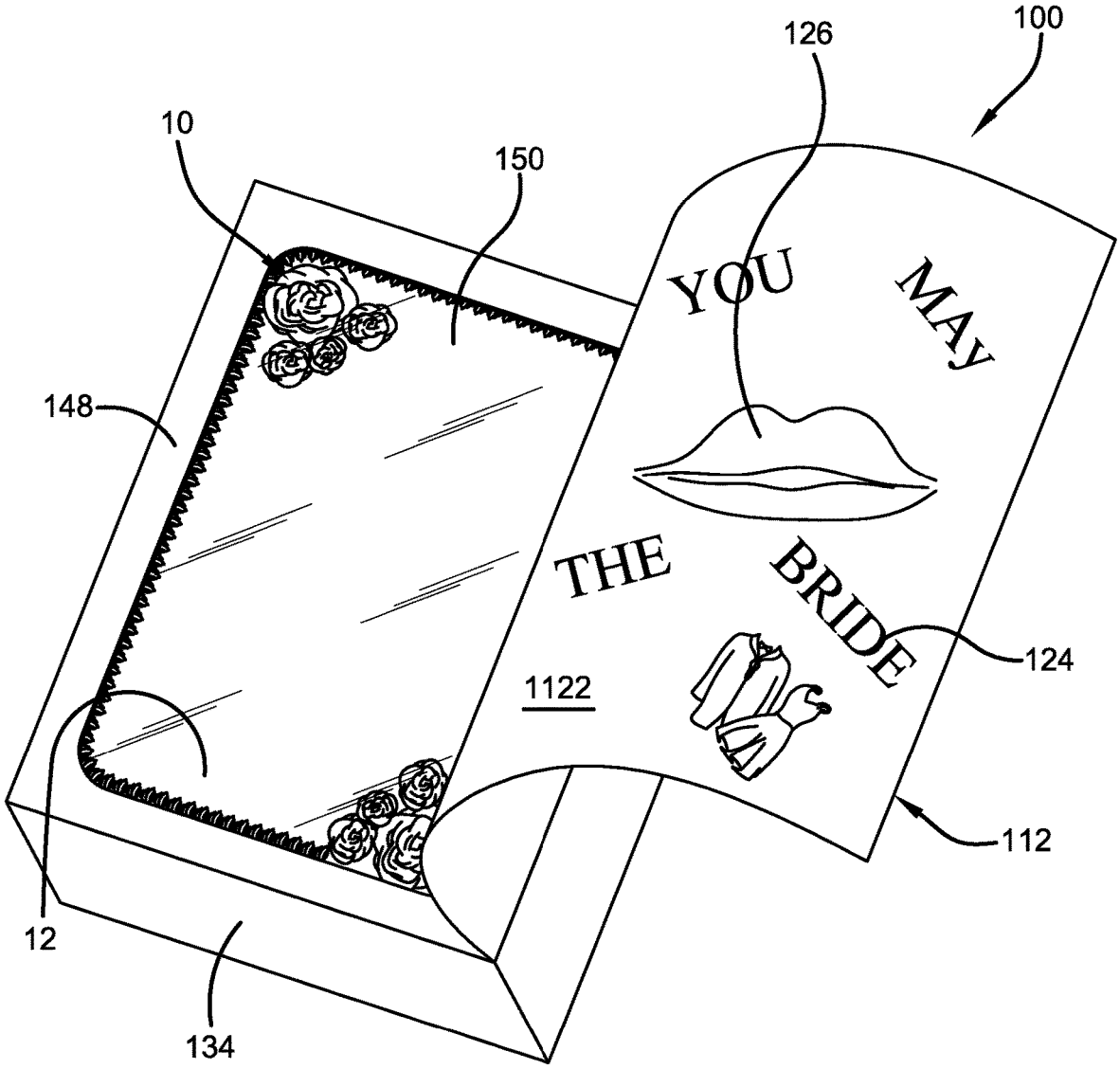
FIG. 5 illustrates a perspective view of one potential embodiment of the combination greeting card and presentation box of the present invention having a transparent viewing window, wherein the greeting card portion is in a partially opened position in accordance with the disclosed structure.

FIG. 5 illustrates a perspective view of one potential embodiment of the combination greeting card and presentation box 100 of the present invention having a generally transparent or translucent viewing window 150, wherein the greeting card portion 110 is in a partially opened position in accordance with the disclosed structure. The viewing window 150 allows a user (not shown) to view the top surface 12 of a cake 10 or other bakery item that is contained within the combination presentation box and gift card 100 without opening the same and, for example, exposing the same to germs.

Figure 6:
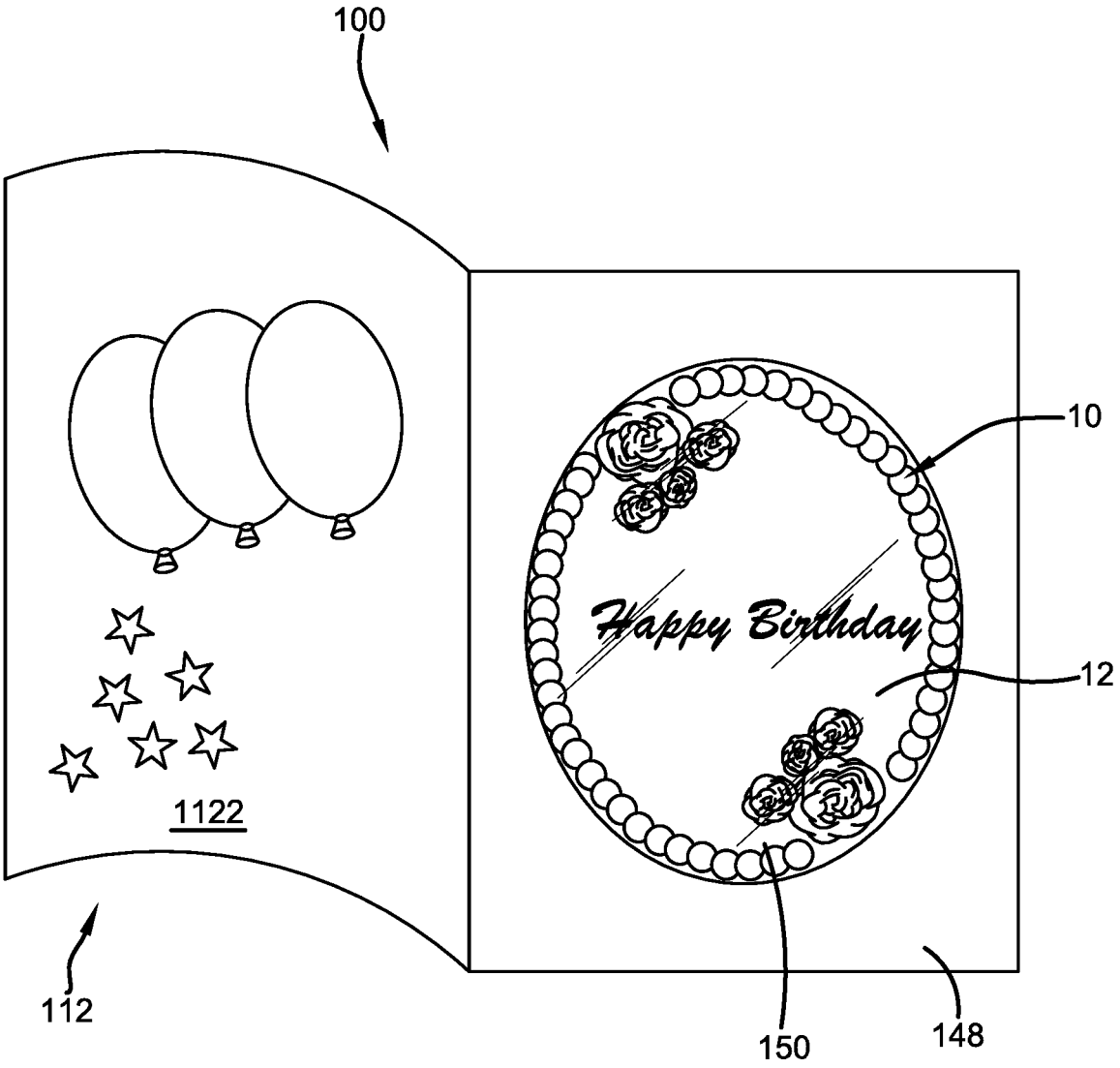
FIG. 6 illustrates a perspective view of one potential embodiment of the combination greeting card and presentation box of the present invention that is comprised of a generally oval shaped transparent viewing window, wherein the greeting card portion is in a partially opened position in accordance with the disclosed structure.

In FIG. 5, the transparent or translucent viewing window 150 is generally square in shape, as compared to the general oval shape of window 150 in FIG. 6. However, it is to be appreciated that the viewing window 150 may be any conceivable shape or size that is conducive to the viewing of the cake 10 and cake top surface 12 without lifting the lid 140 of box 130. It is contemplated that the viewing window 150 may be of any transparent or translucent material or film such as, but not limited to, a vinyl, a glassine, a plastic film, a clear film or the like. The viewing window 150 may also be of a recycled material so that the combination box 100 can be recycled in its entirety and without having to remove the window portion 150 from the box 130 prior to recycling.

In an alternative embodiment of the present invention, combination box and greeting card 100 may comprise the viewing window 150, but not a second greeting card page 120. In other alternative embodiments, combination box and greeting card 100 may comprise only a single greeting card panel and no viewing window 150, wherein the top surface 148 of the lid 140 acts as the de facto second page 120 of the card 110 and have indicia and graphics printed thereon or attached thereto. In addition, the greeting card 100 may also include more than just first and second panels, so that the greeting card 110 can be unfolded to reveal three or more panels contained within the greeting card assembly 110 in, for example, a poster configuration or a book configuration.

As previously stated, it is also contemplated that any of the aforementioned embodiments of the combination box and greeting card 100 could further comprise a speaker 125 or one or more lights 127, such as LED lights, as best shown in FIG. 4. More specifically, speaker 125 may be embedded in the structure of the box 130 or alternatively visible on, for example, the lid 140. The speaker 125 may be activated once the first page 112 of the greeting card 110 has been flipped over or opened, or changed from the first position to the second position, thus revealing the contents of the front surface 122 of the second page 120. The speaker 125 may further comprise a microphone and a memory, thereby also allowing a user to record his or her own custom phrase/song/message or, alternatively, may also be pre-programmed with a specific song (e.g., "Happy Birthday") or message.

In designing the graphics and indicia for the combination box and greeting card 100 as noted above, the user would be given the opportunity to select the music or message to be played, or to record his or her own message at the time of ordering. In addition, it is preferred that the speaker 125 be powered via a rechargeable battery means, such as a USB-rechargeable battery, a single use AA/AAA battery, watch battery or coin battery so that the message and/or music may be played over and over again to the delight of the recipient and his or her guests.

As also mentioned above and best shown in FIG. 4, the combination box and greeting card 100 may also be comprised of a plurality of LED smart lights 127 that can be present on the box 130, the first page 112 and/or second page 120 of the greeting card 110, and that are also powered via the battery and are activated in synchronization with the speaker 125. The lights 127 may come in a variety of different colors and operating modes including, without limitation, lit continuously, slowly fade from bright to off, from off to bright, blink intermittently, etc. In addition, the card 110 or presentation box 130 may be further comprised of a QR code (not shown) which can be scanned by a smart phone or other device such as a tablet in order to trigger the playing of a video on a specific URL or other downloadable application.

FIG. 6 illustrates a perspective view of one potential embodiment of the combination greeting card and presentation box 100 of the present invention that is comprised of a generally oval shaped transparent viewing window 150, wherein the greeting card portion 110 is in a partially opened position in accordance with the disclosed structure. As can be seen from the illustration, each of the elements of the greeting card and presentation box 100 have a matching theme in the appearance of both the graphics and the text. It is also contemplated that text or images could further be included on the interior surface of the lid so that the same are viewable when the lid is lifted.

Notwithstanding the forgoing, the combination cake box and greeting card 100 can by any suitable size, shape, and configuration as is known in the art without affecting the overall concept of the invention, provided that it accomplishes the above stated objectives. One of ordinary skill in the art will appreciate that the shape and size of the combination box 100 and its various components, as show in the FIGS. are for illustrative purposes only, and that many other shapes and sizes of the combination 100 are well within the scope of the present disclosure. Although dimensions of the combination box 100 and its components (i.e., length, width, and height) are important design parameters for good performance, the combination box 100 and its various components may be any shape or size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A combination greeting card and presentation box comprising;

a box having a first theme comprised of a related indicia and an image provided on the box, the box having a plurality of walls, a top and a bottom, wherein the plurality of walls are joined to one another along a plurality of side edges, and the bottom is joined to the plurality of walls along a bottom edge of the plurality of the walls and further wherein the box is formed from a first material;

the top is hingedly attached to one of the walls along a first edge and is configured to permit moving of the top from a first position to a second position; the top further comprising a second, a third and a fourth edge; and a greeting card having a first panel, wherein the first panel is connected to one of the first, second, third or fourth edges of the top, and wherein the first panel moveable from an initial position to a secondary position;

a speaker embedded within the box, the speaker comprising a microphone and a memory; and wherein the speaker is configured to allow a user to record a message and retain a pre-programmed message; and a quick response code, wherein the quick response code of the combination greeting card and presentation box is scannable by a smart phone to trigger access to a video related to the combination greeting card and presentation box.

2. The presentation box of claim 1, wherein the greeting card is provided with a second theme that is related to the first theme of the box.

3. The presentation box of claim 1, wherein the top has an opening contained within a perimeter defined by the first, second, third and fourth edges.

4. The presentation box of claim 3, wherein the opening is at least partially covered with a transparent material or a translucent material thereby creating a window into an interior area of the box.

5. The presentation box of claim 4, wherein the transparent material or the translucent material is selected from a group including a plastic, a glassine, a vinyl and a clear film.

6. The presentation box of claim 3, wherein the greeting card substantially covers the opening and fits within the perimeter of the top.

7. The presentation box of claim 1, wherein the greeting card is provided with a second panel having a theme complementary to the first theme of the box.

8. The presentation box of claim 1, wherein the greeting card is attached to the top substantially adjacent the joining edge.

9. The presentation box of claim 1, wherein the greeting card is made of a second material that is different than the first material.

10. The presentation box of claim 9, wherein the second material is a paper stock and the first material is a card stock.

11. A combination greeting card and presentation box, comprising;

a box having a plurality of side walls joined to one another, a bottom connected to a bottom edge of each of the plurality of side walls, the bottom and the plurality of the side walls forming an enclosure, a top connected to at least one of the side walls forming a joining edge, the joining edge allowing the top to move from a closed position to an open position, the top having a plurality of edges defining a perimeter and a window provided in the top and within the perimeter; and a greeting card connected to at least one of the plurality of edges of the top, the greeting card having a theme, with the theme including both a graphic and a textual information and the greeting card covering the window in the top and movable from a first position to a second position;

a speaker embedded within the box, the speaker comprising a microphone and a memory;

a plurality of lights positioned on the box or the greeting card;

a rechargeable battery for powering the speaker and the plurality of lights; and wherein the speaker is configured to allow a user to record a message and retain a pre-programmed message; and wherein the speaker and the plurality of lights are activated in synchronization; and wherein the plurality of lights are configured in a plurality of different colors and operating modes, the operating modes comprising continuous illumination, slowly fading from bright to off, slowly increasing in an intensity from off to bright, and blinking intermittently.

12. The combination greeting card and presentation box of claim 11, wherein the speaker and the plurality of lights operate simultaneously when the greeting card is moved to the second position.

13. The combination greeting card and presentation box of claim 11, wherein the preprogrammed message is related to the theme of the greeting card.

14. The combination greeting card and presentation box of claim 11, wherein the box is provided with a theme that relates to the theme of the greeting card.

15. The combination greeting card and presentation box of claim 11, wherein the window is made from a material selected from a group including a plastic, a glassine, a vinyl and a clear film.

16. The combination greeting card and presentation box of claim 11, wherein the greeting card and the box are made from two different materials.

* * * * *